United States Patent [19]

Farneti

[11] Patent Number: 4,699,073

[45] Date of Patent: Oct. 13, 1987

[54] SPACED DOUBLE SURFACE SAIL CONSTRUCTION

[75] Inventor: Michael P. Farneti, Palm Beach Shores, Fla.

[73] Assignee: Solar Development, Inc., Riviera Beach, Fla.

[21] Appl. No.: 874,628

[22] Filed: Jun. 16, 1986

[51] Int. Cl.[4] ..... B63H 9/08

[52] U.S. Cl. .....114/102; 114/103, 39

[58] Field of Search ..... 114/90, 91, 97–99, 114/102, 103, 112, 113, 39, 39.2

[56] References Cited

U.S. PATENT DOCUMENTS

| | | | |
|---|---|---|---|
| 2,077,685 | 4/1937 | Gerhardt | 114/103 |
| 3,557,733 | 1/1971 | Mathieu et al. | 114/102 |
| 4,625,671 | 12/1986 | Nishimura | 114/103 |

FOREIGN PATENT DOCUMENTS

| | | | |
|---|---|---|---|
| 2516045 | 5/1983 | France | 114/90 |
| 2541230 | 8/1984 | France | 114/103 |
| 2564416 | 11/1985 | France | 114/91 |

*Primary Examiner*—Sherman D. Basinger
*Attorney, Agent, or Firm*—Jack N. McCarthy

[57] ABSTRACT

A sail envelope has an inner open area between two spaced sail surfaces with spaced battens supported in line from the head of the sail envelope to the foot, between the mast in the open area at the front of the envelope and through sealed openings at the leech of the sail envelope. A batten support strip supports, spaces, and guides the center portion of the battens and a batten socket support strip supports and spaces the batten sockets along the mast. Each batten socket permits pivoting of its cooperating batten. Constraining devices place a compression force on each batten externally of the leech to place a curvature in each batten which is transmitted to one side of the sail envelope with the other side being drawn straighter. The boom attachment opening in the sail envelope is sealed and a drain is located in the foot of the sail envelope. Friction reducing material is used between the mast, sail envelope, and batten sockets where desired.

26 Claims, 16 Drawing Figures

SPACED DOUBLE SURFACE SAIL CONSTRUCTION

TECHNICAL FIELD

This invention relates to improvements in sail envelope construction and relates supporting equipment for use on various types of sailing craft, and especially for wind surfing.

BACKGROUND ART

While sails have been used for propelling a vehicle over water, land and ice for ages, no device could be found which anticipated the combination of the present invention. Batten sockets, some known as camber inducers, by themselves are old and the mast and batten sockets have been covered by a sleeve in the leading edge of a conventional sail. The most pertinent prior art of which applicant is aware consists of the following U.S. Pat. Nos. 2,077,685; 2,569,318; 3,487,800; 4,064,821; 4,335,669; 4,341,176; 4,386,574; 4,530,301 and foreign patents: French Pat. No. 2,541,230; and British Patent No. GB 2 085 387 A.

DISCLOSURE OF INVENTION

An object of this invention is to provide a hollow airfoil type of sail body, said sail body having two spaced external sail surfaces extending from the mast, one from each side thereof, with the two external sail surfaces being formed by a continuous sheet of sail material, said sheet of sail material extending around the mast for slidable movement and being sewn together at the downstream mating ends, forming the leech of the sail envelope. The forward portion of the sail material around the mast can be sewn to have a built-in curvature to apply to the mast.

A further object of the invention is to provide a sail having spaced double sail surfaces forming a sail envelope for increased performance.

Another object of this invention is to provide a sail envelope having one aligned set of battens between the mast and the leech of the sail envelope to provide an outwardly curved shape having a desired curvature to one or the other of both spaced external sail surfaces while placing tension on the remaining external sail surface.

A further object of this invention is to provide a sail having an inner open area between two spaced sail surfaces with a plurality of spaced battens therein between the head and the foot of the sail, each batten extending from the mast in the open area at the luff through the leech of the sail. The front end of each batten is positioned in a batten socket located against the mast while the rear end of each batten projects through a batten seal in the leech to the exterior of the sail. An external batten constraining device places a compression force on the external end of each batten from a connection to the leech of the sail to place a desired curvature in each batten. A batten support strip extends from the head of the sail to the foot and is connected to a point on each batten between its ends to position it for proper horizontal movement, and a batten socket support strip extends down the luff of the sail and is connected to each batten socket to hold them in place along with the forward end of the batten. Drain means are provided at the foot of the sail envelope to permit water to drain out.

Another object of the invention is to provide a friction reducing material when necessary between the mast and sail; the mast and batten sockets; and the sail and batten sockets to obtain proper sliding movement. This material may take the form of a tape, such as Teflon, and extend for the length of the contacting sail and mast surfaces.

A further object of this invention is to provide a seal means on the sail to seal the open area in the sail through which the boom is attached to the mast.

Another object of this invention is to provide a seal means at the leech of the sail to seal between each batten and batten opening.

BEST MODE FOR CARRYING OUT THE INVENTION

Figure 1:
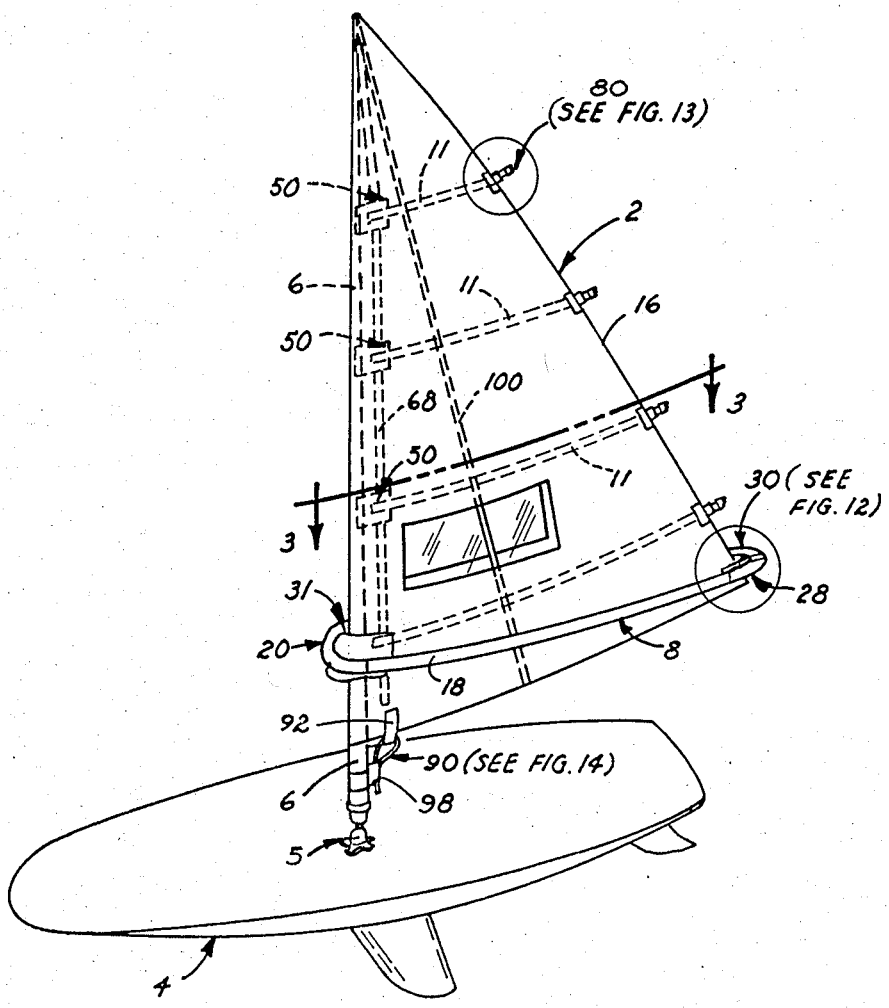
FIG. 1 is a perspective view of a sailboard having a triangular sail envelope with an inner open area, with full battens extending from the mast through said inner open area and projecting through said leech.
Figure 2:
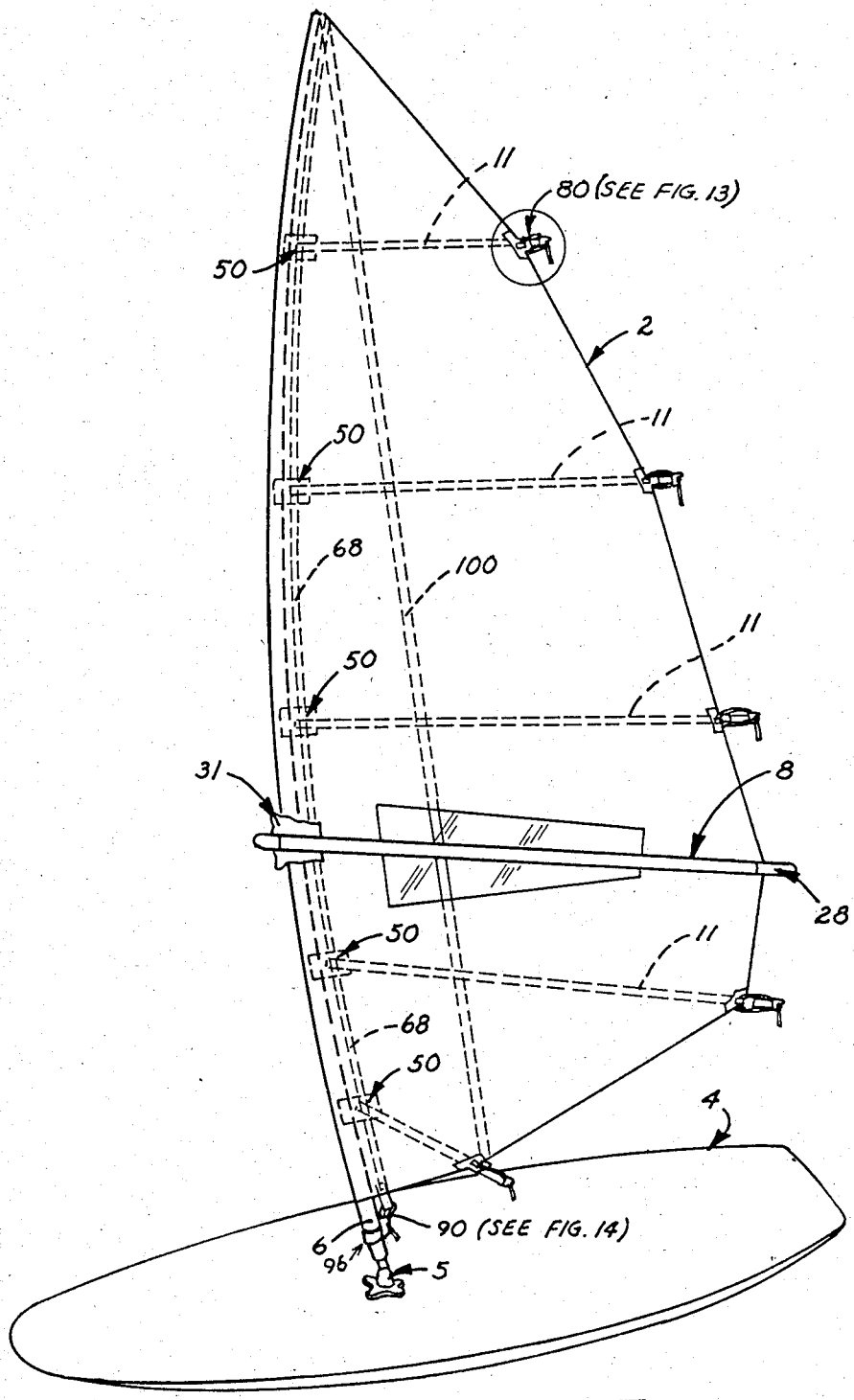
FIG. 2 is a perspective view of a sailboard having a hollow sail envelope of a different configuration where the tensioning of the outhaul curves the mast.

Referring to FIG. 1, a sail envelope 2, having a triangular configuration, is shown on a sailboard 4, enclosing a mast 6. The mast 6 is attached to the sailboard 4 by any known mast attaching means 5 and for a sailboard includes a universal joint, as is well known in the art. When this sail construction is used on a boat, for example, the accepted mast attachment means can be used for that type of craft. A boom 8 is attached at its forward end to the mast 6 and at its rearward end to the clew of the sail envelope 2.

Figure 8:
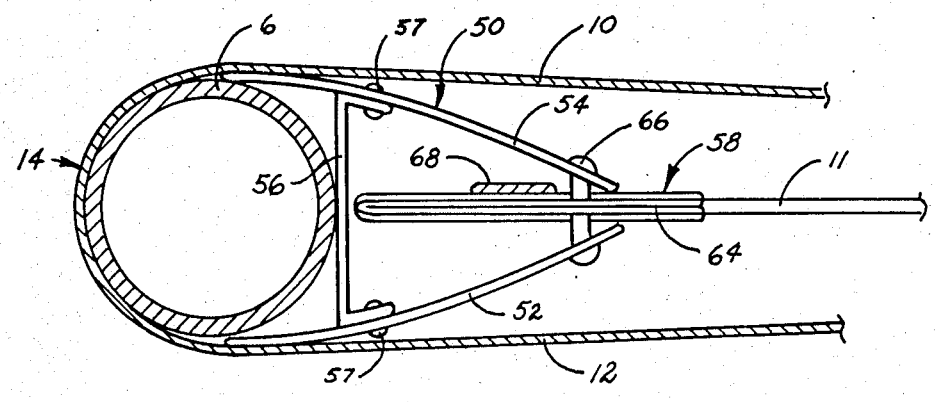
FIG. 8 is a view taken along the line 8—8 of FIG. 7 showing the sock of the batten socket at a midpoint between its side limits of movement and including a sail envelope portion.

The sail envelope 2 has two spaced external sail surfaces 10 and 12 extending from the mast 6, one from each side thereof, forming an open area therebetween. The two sail surfaces 10 and 12 are formed by a continuous sheet of sail material. The continuous sheet of sail material can be made up of a plurality of smaller pieces of sail material if desired, as is known in the sail art. The sheet of sail material extends around the mast 6 at 14 (see FIG. 8) for slidable movement therearound, forming the luff of the sail envelope 2 and being sewn together at the downstream mating ends at 16, forming the leech of the sail envelope 2. The foot of the sail envelope 2 is formed by the sewn together bottom edges of the two spaced external sail surfaces 10 and 12. The foot of the sail is not sewn together at its forward end to provide an opening for passage of the mast 6; the opening is made oversized to provide a drain for any water that does get into the sail envelope 2. Other drain means can be used.

Figure 7:
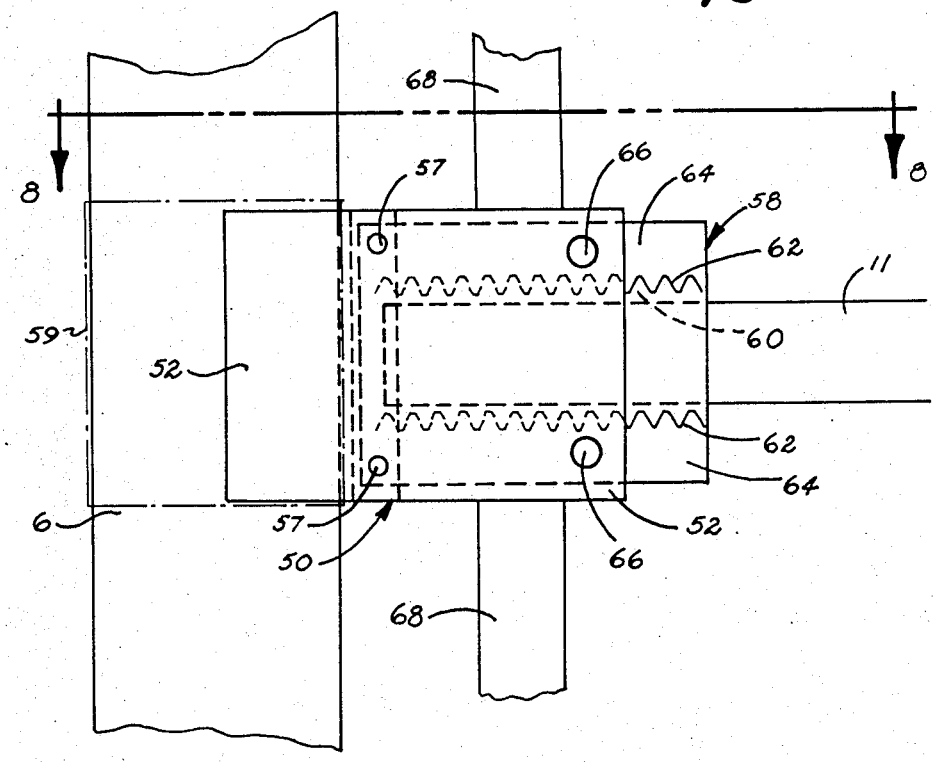
FIG. 7 is a fragmentary side view showing the mast with a batten socket and cooperating forward end of the batten.

A set of battens 11 is provided within spaced sail surfaces 10 and 12 between spaced locations on the mast 6 and spaced locations through the leech to provide a desired curvature to one or the other of both spaced sail surfaces 10 and 12. Each spaced location on the mast 6 includes a batten socket 50 which holds and supports one end of a batten 11. The batten socket 50 shown in FIGS. 7 and 8 has two side plates 52 and 54, spaced at a front end to fit around the mast 6 and angled inwardly to have the back end fit around one end of a batten 11. Each side plate 52 and 54 is connected at a location between its ends by a support plate 56. The plate 56 is shown riveted to each side by rivets 57; welding or other means can be used. The front end of the batten socket 50 extends to a midpoint on the mast 6 and the rear end supports a heavy cloth sock 58 having a pocket 60 for receiving one end of a batten 11. The sock 58 is formed of a piece of the heavy cloth, of approximately the height of the side plates 52 and 54, folded over on itself and sewed down each side at 62, forming a pocket 60 at the center and a double flange 64 on each out side. The sock 58 extends to a point adjacent the support plate 56 and the side plates 52 and 54 angle inwardly to a point near the rear of the sock 58. A large rivet 66 extends through plate 52, double flange 64 and cooperating plate 54 above and below the pocket 60. The opening in each double flange 64 permits sliding on each rivet 66. This allows the sock 58 to pivot about this point so that the end of the batten 11 in the pocket 60 can move with the sock 58 between the inner side of the plate 52 and the other inner side of plate 54. While a specific batten socket 50 has been shown, other known means to hold battens can be used. To support all of the spaced batten sockets 50 at a proper location against the mast 6, a batten socket support strip 68 is sewed to the top of the sail envelope 2 and to the bottom of the sail envelope 2 adjacent the mast 6 and sewed to the cloth sock 58 of each batten socket 50.

Figure 3:
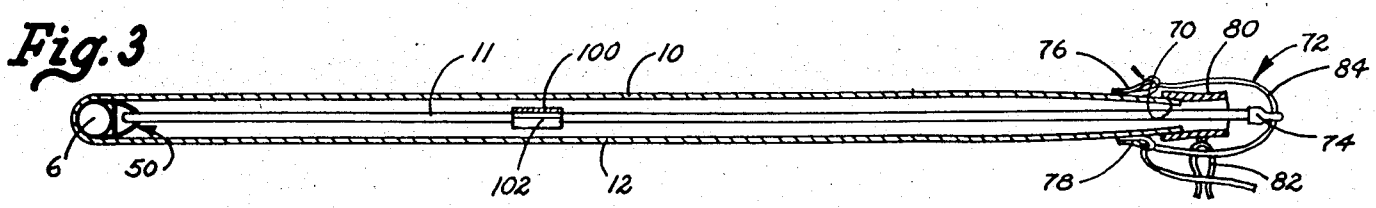
FIG. 3 is a view taken along the line 3—3 of FIG. 1 showing the batten with one end in a batten socket and the other end extending through the leech unconstrained.

An opening 70 is provided in the leech of the sail envelope 2 for each batten 11 (see FIG. 3). These battens 11 are full battens extending from the batten socket 50 through the opening 70 to the exterior of the leech of the sail envelope 2. Constraining means 72 are provided for each batten to compress it within the sail envelope 2 and cause it to curve outwardly to one side of the envelope 2 or the other, and curve the cooperating surface 10 or 12. These battens 11 can be contoured along their length to achieve a desired curvature when compressed between their ends, as is well known in the art.

To support all of the spaced battens 11 at an intermediate point along their length to insure their proper movement laterally within the sail envelope 2, a batten support strip 100 is sewed to the top of the sail envelope adjacent the head and to the bottom of the sail envelope adjacent the foot. A short strap section 102, forming a loop, is sewed to the batten support strip 100 at each desired batten support location. Each batten 11 is mounted in its cooperating loop formed by a short strap section 102. Other desired batten attaching means can be used, including a plurality of support strips 100 and including different widths thereof.

Figure 13:
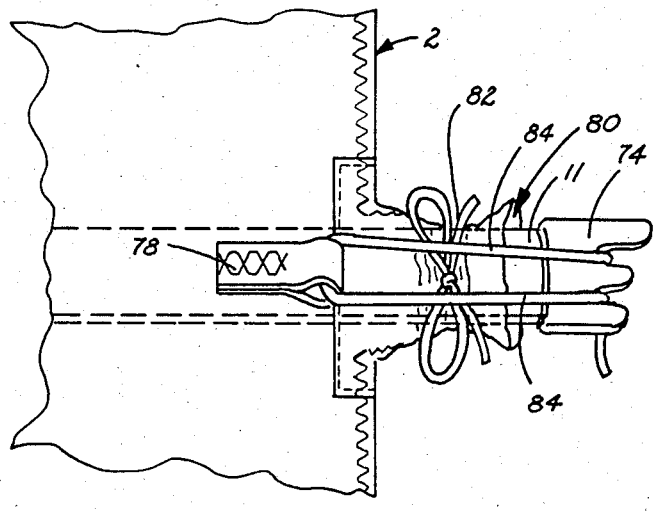
FIG. 13 is a view of a constraining device connected between a batten and the leech of the sail envelope including a sealing sleeve around the batten.

The constraining means 72 comprises an end cap 74 over the end of the batten 11 and two webbing loops 76 and 78 on each side of the leech of the sail envelope 2 in line with the opening 70. A short sealing sleeve 80 is sewn around the opening 70 and has a string 82 attached thereto for a purpose to be hereinafter described (see FIG. 13). A cord 84 is fixedly attached to loop 76 and extends through a guide slot in end cap 74; the cord then extends through the other loop 78. To place a compressive force on the batten 11, the cord 84 is pulled rearwardly, forcing end cap 74 towards the mast 6, causing the batten socket 50 to move to one side or the other. When the desired force is applied, obtaining the desired curvature, then the end of the cord 84 is fixed to the end cap 74, such as by placing in a tapered cleat slot. A constraining device is shown in U.S. Pat. No. 4,335,669. Any known constraining means 72 can be used.

Figure 4:
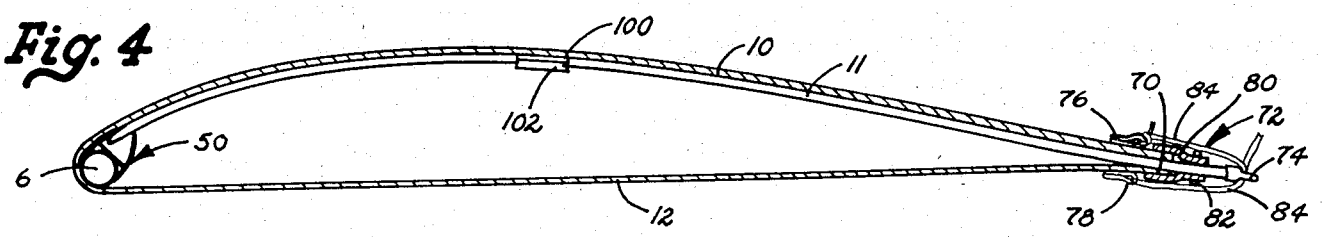
FIG. 4 is a view similar to FIG. 3 showing the external end of the batten constrained to compress the batten and cause it to bow to one side of the sail envelope.
Figure 15:
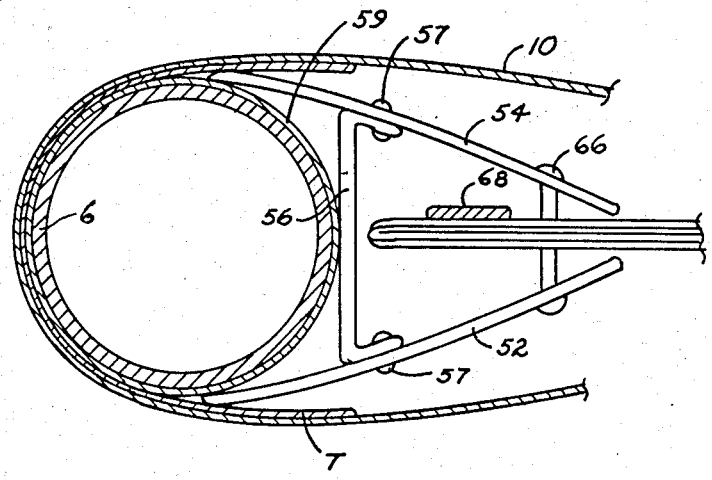
FIG. 15 is an enlarged view of a forward portion of FIG. 8 showing the use of friction reducing material between the mast and sail, the mast and batten sockets, and the sail and batten sockets.
Figure 16:
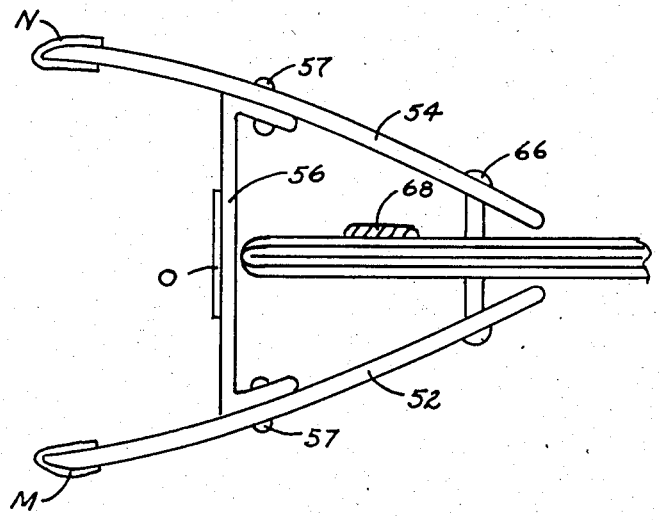
FIG. 16 is an enlarged view of the forward portion of a batten socket showing friction reducing material applied to the forward edges of its side plates and midpoint of its support plate.

As seen in FIG. 4, the batten 11 has been acted upon by the constraining means 72 with cord 84 fixed in its cleat slot; this action has forced the rear end of the batten socket 50 to one side against sail surface 10 and moved the forward portion of the batten socket 50 around the mast 6, causing a curvature on sail surface 10, and drawing sail surface 12 straighter than sail surface 10. To facilitate the sliding movement between the mast 6 and the batten socket 50, a Teflon sleeve 59, shown in phantom in FIG. 7, and in full in FIG. 15, can be fixed around the mast 6 to reduce friction. Other materials providing reduced friction can also be used. The sleeve 59 can be formed as a cylindrical member around the mast 6, or provided by wrapping with a tape. To provide for friction reduction, the portions of the batten socket 50 making contact with the mast 6, or a Teflon sleeve 59, can also be provided with a Teflon tape, or other friction reducing material. This material can be placed around the forward edges of side plates 52 and 54, at M and N, and placed at the midpoint of support plate 56, at 0 (see FIG. 16).

Figure 5:
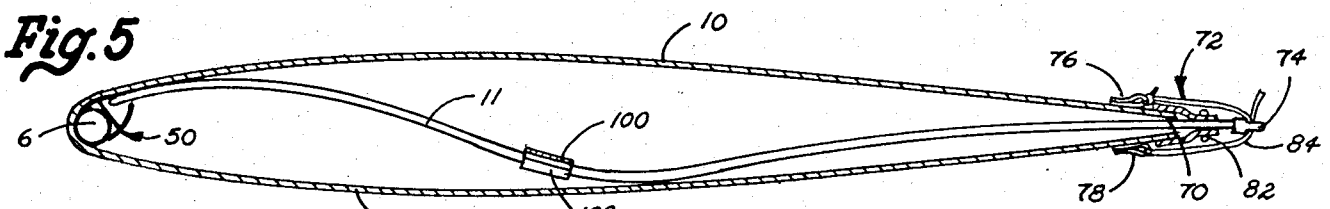
FIG. 5 is a view similar to FIG. 4 showing the position of the batten as it moves from one side of the sail envelope to the other.
Figure 6:
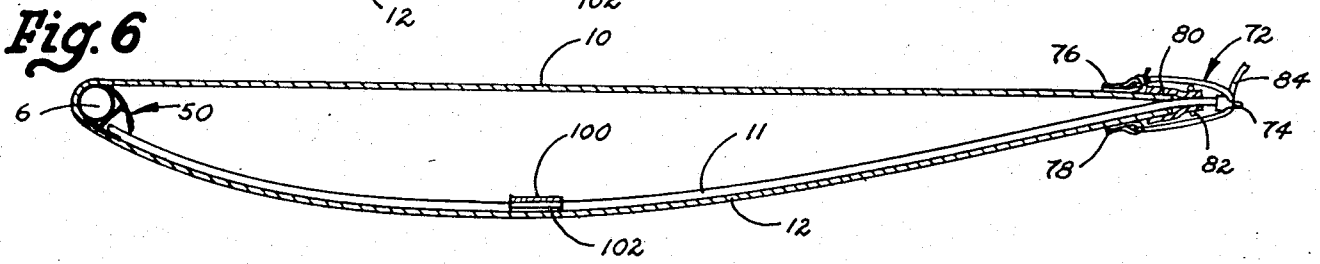
FIG. 6 is a view similar to FIG. 4 showing the positio of the batten against the other side of the sail envelope.

When the curved sail surface 10 is presented to the wind, the wind pressure presses on the sail surface 10 which in turn presses on the battens 11 which cause them to distort (see FIG. 5) and spring out to the interior of the other sail surface 12, causing a curvature of sail surface 12 (see FIG. 6). As the batten 11 goes from one side of the sail envelope to the other, it moves in a distorted manner, providing for the shifting of the sail material around the mast 6. The shifting of the sail material around the mast 6 can also have friction therebetween reduced by friction reducing tape, or material T, such as Teflon, fixed to the sail material which makes contact with the mast 6. Friction reducing tape, or material, can also be added to the mast for the entire length of the contacting sail if desired. After the batten 11 is constrained, its sealing sleeve 80 is brought into sealing contact with it by tying the string 82 around the sealing sleeve 80; this is to prevent water from entering the hollow sail envelope 2.

The boom 8 is of the type used in windsurfing, having two curved boom members 18, one extending around each side of the hollow sail envelope 2 with each being connected at its forward end by a front U-shaped member 20. The U-shaped member 20 has a center rearward projection 21 between the two legs of the U-shape with an arcuate inner surface 22 at its rearward end to cooperate with the mast 6 in a manner to be hereinafter described. Means 24, known an inhaul, are provided to attach the front U-shaped member 20 to the mast 6 through an opening 26 in the sail envelope 2. The boom members 18 are connected at their rearward ends by a rear U-shaped member 28. Means 30, known as outhaul, attach the rear U-shaped member 28 to the clew of the sail envelope 2.

Figure 9:
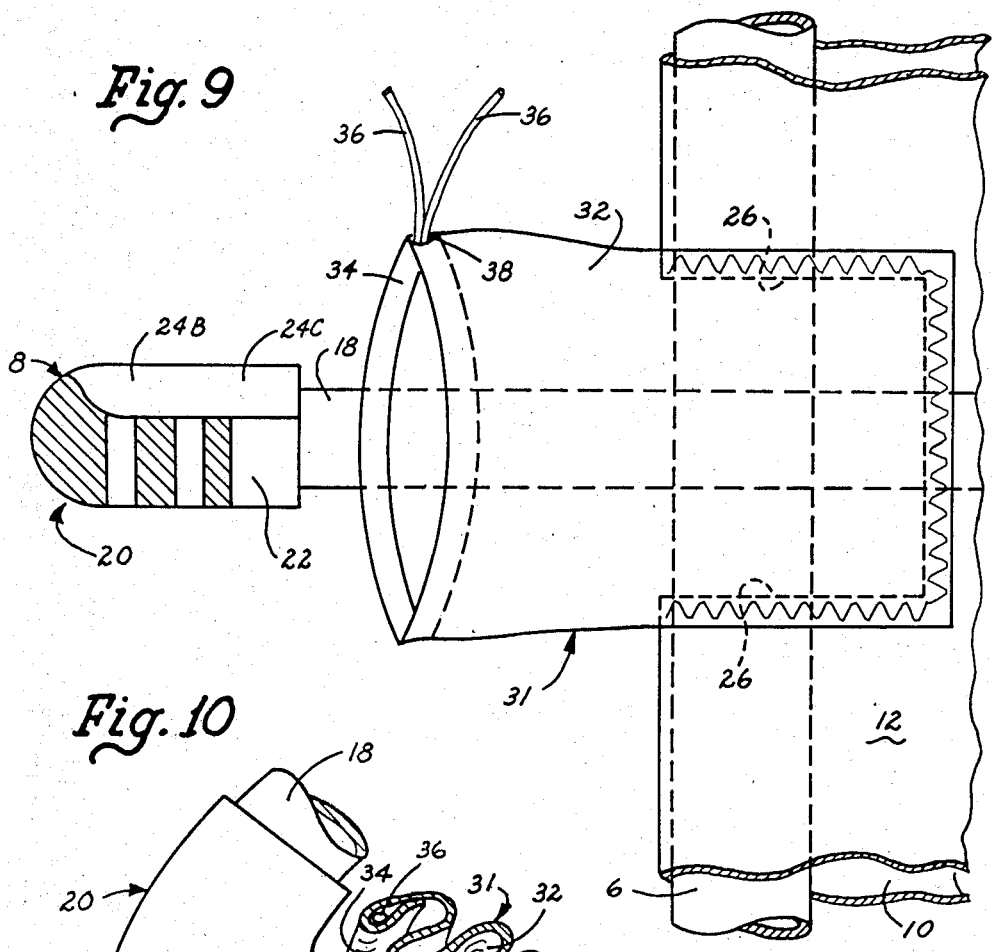
FIG. 9 is a view of the inhaul opening in the front of the sail envelope having a sealing tubular sleeve therearound.

Seal means 31 are provided to seal the opening 26 in the sail envelope 2 with the front U-shaped member 20 to prevent water from entering the sail envelope 2. As seen in FIG. 9, a tubular sleeve 32 of water resistant material has a rear end portion cut to fit around opening 26 in the front portion of the sail envelope 2 and sewn thereto in a waterproof manner; for example, using treated thread, coated needle holes, and taped needle holes. The water resistant material can be one of many materials impervious to water. The front end of the tubular sleeve 32 projects from the opening 26 to permit the front U-shaped member 20 to be connected to the mast 6 by the inhaul means 24. The free front end of the tubular sleeve 32 has its material turned back on itself, forming a drawstring channel 34. A drawstring 36 extends through the channel 34 with both ends coming out of an opening 38 in the channel 34.

Figure 10:
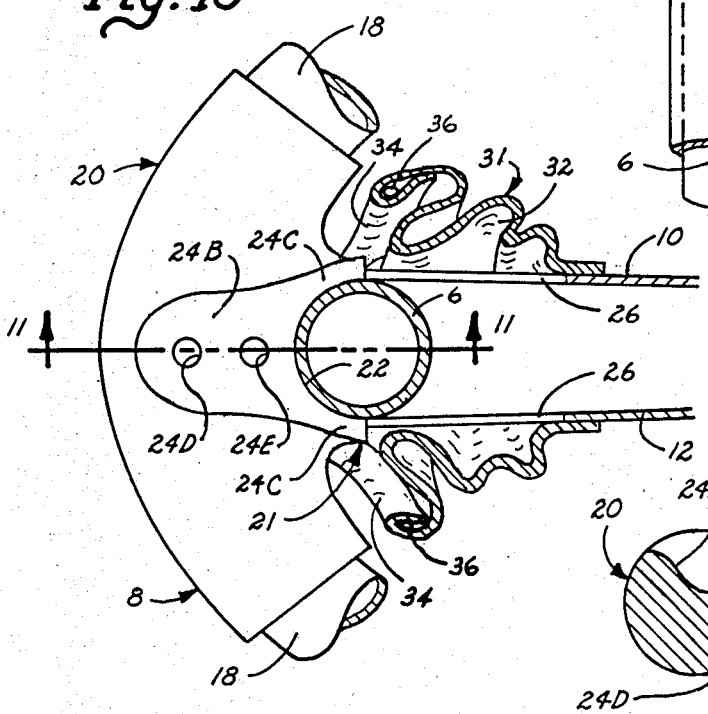
FIG. 10 is a fragmentary view of a portion of the front of the sail envelope taken through the inhaul opening just above the front portion of the boom showing the sealing tubular sleeve pulled back.
Figure 11:
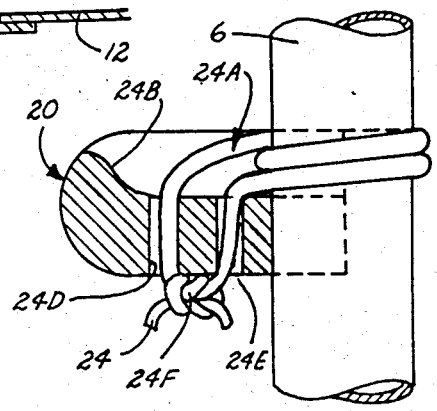
FIG. 11 is a view taken on the line 11—11 of FIG. 10 with the inhaul rope in place around the mast and through the front U-shaped member.
Figure 12:
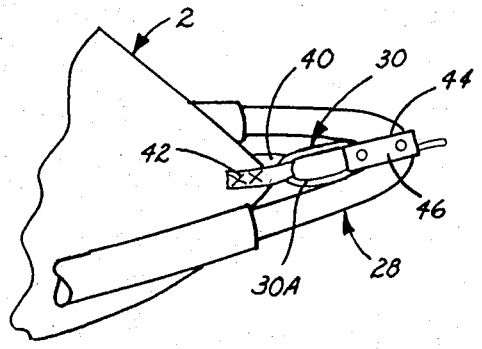
FIG. 12 is a view of the outhaul device.

To place the arcuate inner surface 22 of front U-shaped member 20 against the mast 6, the boom 8 is first placed around the sail envelope 2 and mast 6 with the front U-shaped member 20 opposite the opening 26 (see FIG. 9). The forward projecting end of the tubular sleeve 32 is pushed away from the front of the boom 8 back over the sail envelope 2 around mast 6, exposing the mast 6 through the opening 26; the front U-shaped member 20 is then brought in position with its arcuate inner surface 22 against the mast 6 (see FIG. 10). Inhaul means 24 is then connected between the mast 6 and the front U-shaped member 20, fixing them together. The inhaul means 24 shown includes a rope, or cord, 24A, wrapped around the mast 6 twice and tied to the front U-shaped member 20. For receiving the rope, or cord, 24A, the front U-shaped member 20 has a recess 24B in the top of the center part which extends from the forward part rearwardly around the top of the arcuate inner surface 22 at 24C on both sides to the ends thereof. Two holes 24D and 24E extend from the recess 24B to the bottom of the front U-shaped member 20. When the rope, or cord, 24A is wrapped around the mast 6, it fits in the recess 24C adjacent each side of the mast 6 and each end of the rope, or cord, 24A, extends into the forward part of recess 24B where one end extends downwardly through hole 24D and the other end extends downwardly through hole 24E. The ends of the rope, or cord, 24A, are tied in a knot 24F under the front U-shaped member 20, forming the inhaul (see FIG. 11).

After the inhaul means 24 is in place, the forward projecting end of the tubular sleeve 32, having the drawstring channel 34, is pulled over the arcuate inner surface 22 to have the drawstring 36 pulled tight to press the end of the tubular sleeve 32 against and around the center rearward projection 21 of the front U-shaped member 20, sealing the opening 26. Any one of many inhaul means can be used.

The outhaul means 30 shown includes a rope, or cord, 30A, connected between the loop 40 of a strap 42 sewed to the clew of the sail envelope 2 and a bracket 44 on the rear curved portion of the rear U-shaped member 28. The rope, or cord, 30A, can be tensioned as desired and held in position by holding means 46. Any one of many known outhaul devices can be used.

Figure 14:
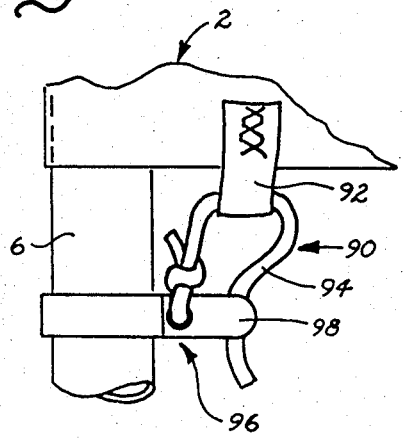
FIG. 14 is a view of the tack of the sail envelope showing the downhaul connection.

Means 90, known as downhaul, attaches the foot of the sail envelope 2 adjacent the luff to the bottom of the bast 6, or to a mast attaching means, to tension the sail envelope 2. A rope 94 is shown having one end attached to a bracket 96 with the other end extending through a loop 92 sewed to the sail envelope and connected to a cleat 98 at the end of bracket 96 (see FIG. 14). Any known downhaul means can be used.

A regular type straight boom could extend rearwardly from the mast 6 within the sail envelope 2, if desired. The straight boom would be inserted in the opening in the foot of the hollow sail envelope 2 for the mast 6 and have its rear end properly positioned in a reinforced portion at the clew; the mast 6 would then be inserted with the boom being attached to the mast 6 at a desired location. The mast 6 with its top end properly positioned in its reinforced portion at the head, would have the sail envelope 2 tensioned by the downhaul means 90.

After insertion of any mast 6 into a hollow sail envelope 2, the batten sockets 50 have their spaced front ends positioned around the mast 6 for assembly before the luff is tensioned by the downhaul means 90. The opening for the mast 6 can be brought close to the mast 6 by the use of attaching means such as Velcro, leaving just enough space for a drain.

I claim:

1. A sail and supporting means, said sail comprising sail material forming a sail envelope having two spaced sides, said sail material forming the forward portion of the sail envelope from head to tack for passing around a mast, said sail material connected together rearwardly of the forward portion forming the leech of the sail envelope between the head and clew, said two spaced sides extending from the forward portion to said leech, said sail material connected together at the bottom forming the foot of the sail envelope between the tack and clew, an opening in the forward end of said foot of said sail envelope for receiving a mast, a plurality of spaced curvable battens within said sail envelope for lateral movement between the two spaced sides of said sail envelope to shape said sail envelope, a plurality of spaced batten sockets for contacting a mast within said sail envelope, one spaced batten socket for each batten, each spaced batten socket having means for supporting the forward end of a batten, means connected within said sail envelope to at least one intermediate point on a plurality of said battens to properly position them for lateral movement within the sail envelope between one side of the sail envelope and the other, and means for connecting a plurality of the rear ends of said battens to said leech of the sail envelope to place a compression force on the end of each batten to produce a curvature in each batten towards one side of said sail envelope or the other.

2. A combination as set forth in claim 1 wherein each of the plurality of batten sockets has two side plates with front ends extending forwardly to fit around a mast and an interconnecting support plate for contacting the rear of a mast, the front ends having a friction reducing material therearound for contacting a mast and said sail envelope, the interconnecting support plate having friction reducing material for contacting a mast.

3. A combination as set forth in claim 2 wherein said two side plates of each batten socket have rear ends extending rearwardly and angled inwardly to provide an opening for the forward end of a batten, means connecting the rear ends of said two side plates at the top and bottom thereof, a pocket means located between said two side plates having a pocket extending between said connecting means for receiving the forward end of a batten, said pocket means being mounted for pivotal movement on said connecting means between the rear ends of said two side plates.

4. A combination as set forth in claim 3 wherein said connecting means comprises a first rivet at the top of the two side plates and a second rivet at the bottom of the two side plates, said pocket means having a first opening above said pocket and a second opening below said pocket, said first opening being mounted on said first rivet between said two side plates, and said second opening being mounted on said second rivet between said two side plates.

5. A combination as set forth in claim 4 wherein a first flange extends upwardly from the pocket means above the pocket, a second flange extends downwardly from the pocket means below the pocket, said first opening being located in said first flange, and said second opening being located in said second flange.

6. A combination as set forth in claim 2 wherein the forward portion of the sail envelope has a forward opening for exposing a mast for connection to a boom, means for sealing said forward opening to prevent water from getting into the sail envelope.

7. A combination as set forth in claim 1 including a batten opening in the leech of the sail envelope for each of a plurality of said laterally movable battens, each batten having a rear end extending through a batten opening to a point externally of said sail envelope, said connecting means for placing a compression force on the rear end of each batten being located between the rear end of each batten externally of said sail envelope and the leech of said sail envelope for compressing each batten against its cooperating batten socket to curve it against one side of said sail envelope or the other from the forward portion of said sail envelope to the leech of said sail envelope between the head and clew.

8. A combination as set forth in claim 7 wherein a sealing means is attached to said sail envelope around each batten opening at the leech of said sail envelope, a batten extending through each batten opening extends through its cooperating sealing means, said sealing means sealing said sail envelope against its cooperating batten to prevent water from getting into the sail envelope.

9. A combination as set forth in claim 8 wherein said sealing means is a sealing sleeve attached around each batten opening, a batten extending through each batten opening extends through its cooperating sealing sleeve, means pressing said sealing sleeve against its cooperating batten to prevent water from getting into said sail envelope.

10. A combination as set forth in claim 9 wherein the forward portion of the sail envelope has a forward opening for exposing a mast for connection to a boom, means for sealing said forward opening to prevent water from getting into the sail envelope.

11. A combination as set forth in claim 8 wherein the forward portion of the sail envelope has a forward opening for exposing a mast for connection to a boom, means for sealing said forward opening to prevent water from getting into the sail envelope.

12. A combination as set forth in claim 1 wherein said means connected to at least one intermediate point on a plurality of said battens to properly position them for lateral movement within the sail envelope includes a strap having one end fixed to said sail envelope adjacent the head and the other end fixed adjacent the foot, said strap being connected to each batten as it crosses it.

13. A combination as set forth in claim 12 including a batten opening in the leech of the sail envelope for each of a plurality of said laterally movable battens, each batten having a rear end extending through a batten opening to a point externally of said sail envelope, said connecting means for placing a compression force on the rear end of each batten being located between the rear end of each batten externally of said sail envelope and the leech of said sail envelope for compressing each batten against its cooperating batten socket to curve it against one side of said sail envelope or the other from the forward portion of said sail envelope to the leech of said sail envelope between the head and clew, a sealing means is attached to said sail envelope around each batten opening at the leech of said sail envelope, a batten extending through each batten opening extends through its cooperating sealing means, said sealing means sealing said sail envelope against its cooperating batten to prevent water from getting into the sail envelope, the forward portion of the sail envelope having a forward opening for exposing a mast for connection to a boom, means for sealing said forward opening to prevent water from getting into the sail envelope.

14. A combination as set forth in claim 1 wherein the forward portion of the sail envelope has a forward opening for exposing a mast for connection to a boom, means for sealing said forward opening to prevent water from getting into the sail envelope.

15. A combination as set forth in claim 14 wherein said sealing means includes a flexible water resistant tubular means for closing said forward opening.

16. A sail and supporting means, a mast, said sail comprising sail material forming a sail envelope having two spaced sides, said sail material forming the forward portion of the sail envelope from head to tack for passing around and contacting said mast, said sail material connected together rearwardly of the forward portion forming the leech of the sail envelope between the head and clew, said two spaced sides extending from the forward portion to said leech, said sail material connected together at the bottom forming the foot of the sail envelope between the tack and clew, an opening in the forward end of said foot of said sail envelope receiving said mast, a plurality of spaced curvable battens within said sail envelope for lateral movement between the two spaced sides of said sail envelope to shape said sail envelope, a plurality of spaced batten sockets contacting said mast within said sail envelope, one spaced batten socket for each batten, each spaced batten socket having means for supporting the forward end of a batten, means connected within said sail envelope to at least one intermediate point on a plurality of said battens to properly position them for lateral movement within the sail envelope between one side of the sail envelope and the other, and means connecting a plurality of the rear ends of said battens to said leech of the sail envelope to place a compression force on the end of each batten to produce a curvature in each batten towards one side of said sail envelope or the other.

17. A combination as set forth in claim 16 including a boom means, the forward portion of the sail envelope having a forward opening exposing the mast for connection to said boom means, means connecting said boom means to said mast, means sealing said opening to prevent water from getting into the sail envelope.

18. A combination as set forth in claim 17 wherein said connecting means extends through said forward opening, said sealing means including a flexible water resistant tubular means having one end connected around said forward opening and being sealed around said connecting means.

19. A combination as set forth in claim 17 wherein said means connected to at least one intermediate point on a plurality of said battens to properly position them for lateral movement within said sail envelope includes a strap having one end fixed to said sail envelope adjacent the head and the other end fixed adjacent the foot, said strap being connected to each batten as it crosses it.

20. A combination as set forth in claim 17 including a batten opening in the leech of the sail envelope for each of a plurality of said laterally movable battens, each batten having a rear end extending through a batten opening to a point externally of said sail envelope, said connecting means for placing a compression force on the rear end of each batten being located between the rear end of each batten externally of said sail envelope and the leech of said sail envelope for compressing each batten against its cooperating batten socket to curve it against one side of said sail envelope or the other from the forward portion of said sail envelope to the leech of said sail envelope between the head and clew, a sealing means is attached to said sail envelope around each batten opening at the leech of said sail envelope, a batten extending through each batten opening extends through its cooperating sealing means, said sealing means sealing said sail envelope against its cooperating batten to prevent water from getting into said sail envelope.

21. A combination as set forth in claim 16 wherein said means connected to at least one intermediate point on a plurality of said battens to properly position them for lateral movement within the sail envelope includes a batten support strip having one end fixed to said sail envelope above said plurality of battens and the other end fixed to said sail envelope below said plurality of battens, said strip being connected to each batten as it crosses it.

22. A combination as set forth in claim 16 wherein each of the plurality of batten sockets has two side plates with front ends extending forwardly to fit around a mast and an interconnecting support plate for contacting the rear of a mast, said two side plates having rear ends extending rearwardly and angled inwardly to provide an opening for the forward end of a batten, means connecting the rear ends of said two side plates at the top and bottom thereof, a pocket means located between said two side plates having a pocket extending between said connecting means for receiving the forward end of a baten, said pocket means being mounted for pivotal movement on said connecting means between the rear ends of said two side plates.

23. A batten socket for positioning the front end of a batten with a mast for movement relative to a mast, said batten socket having two side plates with front ends extending forwardly to fit around a mast and rear ends extending rearwardly and angled inwardly to provide an opening for the forward end of a batten, an interconnecting support plate being connected between the front ends and rear ends of said two side plates for contacting the rear of a mast, sock means for supporting the forward end of a batten between the rear ends of said batten socket, said sock means having a pocket for receiving the forward end of a batten, said sock means having an upwardly and downwardly extending flange, said upwardly extending flange extending above the pocket and said downwardly extending flange extending below the pocket, each upwardly and downwardly extending flange having an opening therethrough, one rivet extending through the rear ends of said side plates above said pocket and through the opening in said upwardly extending flange, a second rivet extending through the rear ends of said side plates below said pocket and through the opening in said downwardly extending flange, said pocket having a pivotal movement between the inner sides of the two side plates, said first and second rivets supporting the rear ends of said side plates and positioning said sock means for pivotal movement.

24. A combination as set forth in claim 23 wherein said batten socket has friction reducing material fixed thereto, the front ends of said two side plates having a friction reducing material thereon for contacting a mast, and the interconnecting support plate having friction reducing material for contacting a mast.

25. A combination as set forth in claim 24 wherein the batten socket is for positioning the forward end of a batten in a sail envelope, the front ends of said two side plates having a friction reducing material thereon for contacting a sail envelope.

26. A combination as set forth in claim 23 wherein said interconnecting support plate has a midpoint portion positioned for contacting a mast, said side plates having their front ends positioned for contacting a mast, friction reducing material fixed to the midpoint portion of said interconnecting support plate for contacting a mast, friction reducing material fixed to the front ends of said side plates for contacting a mast.

* * * * *